US009309737B2

(12) United States Patent
Alexander et al.

(10) Patent No.: US 9,309,737 B2
(45) Date of Patent: Apr. 12, 2016

(54) ROTATIONAL SHEAR VALVE

(75) Inventors: David J. Alexander, Aberdeen (GB); Prabhu Palanisamy, Aberdeen (GB); Hussain Hashemizadeh, Aberdeen (GB)

(73) Assignee: Vetco Gray U.K. Limited, Houston, TX (US)

( * ) Notice: Subject to any disclaimer, the term of this patent is extended or adjusted under 35 U.S.C. 154(b) by 880 days.

(21) Appl. No.: 13/492,223

(22) Filed: Jun. 8, 2012

(65) Prior Publication Data

US 2013/0327536 A1 Dec. 12, 2013

(51) Int. Cl.

| | |
|---|---|
| ***E21B 33/06*** | (2006.01) |
| ***E21B 29/04*** | (2006.01) |
| ***E21B 29/08*** | (2006.01) |

(52) U.S. Cl.

CPC ..... *E21B 29/04* (2013.01); *E21B 29/08* (2013.01)

(58) Field of Classification Search

CPC ..... E21B 29/04; E21B 29/08
USPC ..... 251/1.1, 1.2, 1.3, 251, 254, 326; 166/363, 364, 55.6
See application file for complete search history.

(56) References Cited

U.S. PATENT DOCUMENTS

| | | | | | |
|---|---|---|---|---|---|
| 1,648,107 | A | * | 11/1927 | Brogdon et al. | 137/318 |
| 3,763,890 | A | * | 10/1973 | Wolf | 137/614.17 |
| 3,893,478 | A | * | 7/1975 | Peters | 137/614.2 |
| 4,215,749 | A | * | 8/1980 | Dare et al. | 166/361 |
| 4,262,693 | A | * | 4/1981 | Giebeler | 137/494 |
| 4,513,823 | A | | 4/1985 | Hynes et al. | |
| 4,519,575 | A | * | 5/1985 | Akkerman et al. | 251/58 |
| 4,612,983 | A | * | 9/1986 | Karr, Jr. | 166/55 |
| 4,911,410 | A | * | 3/1990 | Baker | 251/327 |
| 5,161,617 | A | * | 11/1992 | Marschke | 166/298 |
| 5,199,493 | A | | 4/1993 | Sodder, Jr. | |
| 5,284,209 | A | * | 2/1994 | Godfrey | 166/380 |
| 5,327,923 | A | * | 7/1994 | Eischen et al. | 137/15.17 |
| 5,370,362 | A | * | 12/1994 | Kent et al. | 251/326 |
| 5,931,442 | A | * | 8/1999 | Cummins | 251/1.1 |
| 8,567,490 | B2 | * | 10/2013 | Van Winkle | 166/85.4 |
| 2006/0102359 | A1 | * | 5/2006 | Brown et al. | 166/379 |
| 2014/0264099 | A1 | * | 9/2014 | Melancon | 251/1.1 |

FOREIGN PATENT DOCUMENTS

| | | | |
|---|---|---|---|
| GB | 2352494 | A | 1/2001 |
| WO | 9216714 | A1 | 10/1992 |
| WO | 9937883 | A1 | 7/1999 |

OTHER PUBLICATIONS

PCT Search Report and Written Opinion issued Jun. 18, 2014 in connection with corresponding PCT Patent Application No. PCT/EP2013/061748.

* cited by examiner

*Primary Examiner* — Marina Tietjen
*Assistant Examiner* — Umashankar Venkatesan
(74) *Attorney, Agent, or Firm* — Bracewell LLP

(57) ABSTRACT

A rotating gate valve can be used to shear cables or tubing as it closes to obstruct flow. In embodiments, a valve body can have a flow passage and a lateral bore that is transverse to the flow passage. The gate can have a generally cylindrical shape and can rotate about the axis of the gate as it moves laterally to close a flow passage. The lateral and rotational movement can shear articles such as, for example, cables and tubing that extend through the flow passage.

17 Claims, 6 Drawing Sheets

ROTATIONAL SHEAR VALVE

BACKGROUND OF THE INVENTION

1. Field of the Invention

The present invention relates in general to mineral recovery wells, and in particular to an apparatus and method for sealing a tubular member.

2. Brief Description of Related Art

Wire line operations in a wellbore involve lowering a tool on a wire or cable, through a tubular member, into the wellbore. Similarly, coil tubing is often inserted through a riser and wellhead assembly into a wellbore. Under some circumstances, it is necessary to seal the tubular member without first withdrawing the cable or coil tubing. In these circumstances, a shear gate valve can be used to shear, or sever, the cable or coil tubing. Current designs of shear gate valves rely on a single longitudinal motion (primary motion of the gate) to provide a cutting action. There are problems associated with the sealing of gate valves after shearing coil tubing, wireline, or a combination of both, when the shearing is performed by longitudinal motion of the gate. Seemingly minor damage to the surfaces of the gate and seats can have an effect on the ability of the valve to seal.

SUMMARY OF THE INVENTION

Embodiments of the present invention can include a valve design featuring a profiled seat and a cylindrical gate design. The cylindrical gate operation can incorporate both a longitudinal and a rotational movement for valve actuation to shear of coil tubing, wireline, or a combination of both.

In various embodiments, a valve assembly can use a longitudinal and a rotational movement of a cylindrical gate in order to induce an alternative technique of shearing coil tubing, wireline, or a combination of both. The rotational movement can produce a second motion to the cutting interface of a shear valve during a cutting operation. The secondary motion can be at 90 degrees or at other angles relative to the primary motion of the gate. This can result in a cleaner cut of the coil tubing, wireline, or combination of both. Current designs of shear gate valves rely on a single longitudinal motion (primary motion) to provide the cutting action. The rotational movement provided by embodiments of the rotational shear valve can, in addition to adding a secondary motion to the cutting operation, tend to sweep any strands of wire or extruded material into the cavities of the valve rather than capturing this material and damaging the gate to seat interface. Embodiments can remove or reduce the likelihood of damage to sealing surfaces in gate valves.

Embodiments of the present invention can include a valve assembly that can have a valve body having an axial flow passage therethrough and a lateral bore transverse to the axial flow passage. Embodiments can also include a gate. The gate can have a cylinder rotated about a gate axis, the gate being located within the lateral bore and moveable in a longitudinal direction along the gate axis from an open position to a closed position. The gate can permit flow through the flow passage in the open position and a solid portion of the outer diameter of the gate can obstruct the flow passage in the closed position. The gate can rotate about the gate axis while moving axially from the open position to a closed position.

In embodiments of the valve assembly, the gate can include an orifice, the orifice being perpendicular to the gate axis and having opposite ends at the outer diameter of the gate, the orifice registering with the axial flow passage in the open position. In embodiments, the gate can include a slot on the outer diameter of the gate, the slot having a helical portion extending around the outer diameter as it extends in the direction of the gate axis, and the valve body can include a key, at least a portion of the key being located in the slot, so that when the gate moves along the gate axis, the key causes the gate to rotate about the gate axis. In embodiments, the slot can have a straight portion that extends along the gate axis and does not rotate helical fashion about the outer diameter and the key is located in the straight portion of the slot when the valve is in the open position so that when the gate moves from the open position to the closed position, the gate initially moves along the gate axis without rotating and then begins rotating when the key reaches the helical slot.

In embodiments of the valve assembly, the gate can include an orifice, the orifice being perpendicular to the gate axis and having opposite ends at the outer diameter of the gate. The orifice can register with the axial flow passage in the open position. The orifice can include a shear surface, the shear surface being the last portion of the orifice to register with the axial flow passage as the gate moves from the open position to the closed position. The transition from the straight portion of the slot to the curved portion of the slot can be a predetermined axial distance from the shear surface of the orifice so that the gate begins to rotate when the shear surface is the preselected distance crossing a circumference of the flow passage.

In embodiments of the valve assembly, a valve stem can be connected to an end of the gate and an actuator can be connected to the valve stem, the actuator creating force in the direction of the gate axis to urge the gate, via the valve stem, between the open and closed positions.

In embodiments of the valve assembly, the valve body can include a slot on an inner diameter of the lateral bore, the slot having a helical portion extending around the outer diameter as it extends in the direction of the gate axis, and the gate can include a key protruding from the gate, at least a portion of the key being located in the slot, so that when the gate moves along the gate axis, the key causes the gate to rotate about the gate axis. In embodiments of the valve assembly the valve body can include a cylindrical sleeve lining the lateral bore, the sleeve defining the inner diameter of the lateral bore and the slot being located on an inner diameter of the sleeve.

In embodiments of the valve assembly, the gate can include an end face, the end face having a shear surface, and the shear surface can rotate about the gate axis while the gate is moving from the open to closed position.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
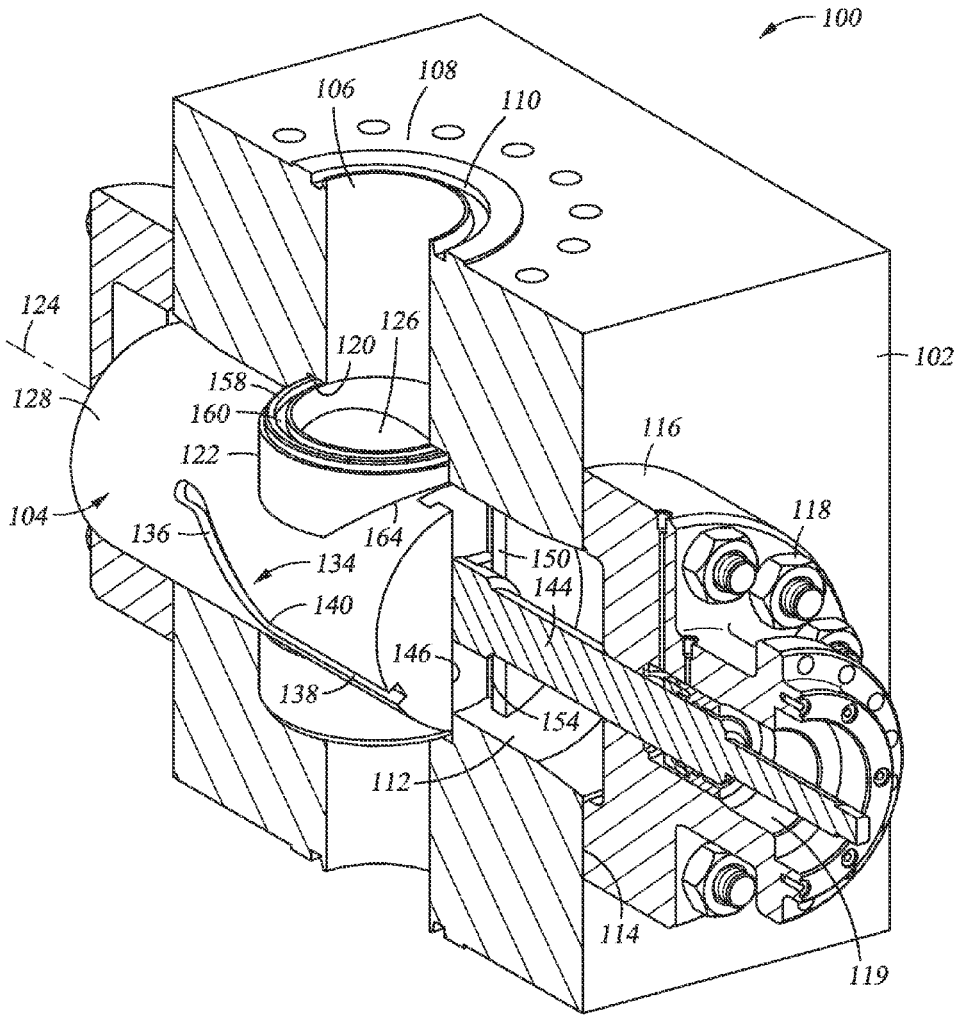
FIG. 1 is a partially sectional isometric view of a rotational shear valve according to an embodiment of the invention.

Referring to FIG. 1, a valve assembly 100 is a valve assembly that can be used to selectively control the flow of fluids through a passage. Valve assembly 100 can be used, for example, to control flow through a tubular member such as a wellhead housing or a riser that is connected to a wellbore (not shown) of a mineral recovery well. Embodiments of valve assembly 100 can include a valve body 102 and a rotating gate or cylinder 104.

Valve body 102 is a valve housing having an axial flow passage 106. Axial flow passage 106 can be a cylindrical bore through which fluid can flow. Various drilling equipment including, for example, wireline run tools and coil tubing, can be passed through axial flow passage 106 when gate 104 is in an open position. Axial flow passage 106 can be oriented vertically when, for example, valve body 102 is connected to a riser or wellhead housing, or it can be oriented at an angle depending on its application. For purposes of this specification, a vertical orientation shall indicate that axial flow passage 106 is aligned with the wellbore or riser to which it is attached, unless otherwise indicated.

Valve body 102 can have connector 108 for connecting axial flow passage 106 to a tubular member (not shown). Connector 108 can include, for example, threaded bolt holes as shown in FIG. 1. Alternatively, connector 108 can include a flange 109 (FIG. 2), a threaded receptacle for receiving a threaded pipe, studs, or any other device for connecting to an adjacent tubular member or member having a flow passage. Connector 108 can include a sealing member for forming a seal against an adjacent member such as, for example, seal groove 110.

Lateral bore 112 is a cylindrical bore through valve body 102. The axis of lateral bore 112 is generally perpendicular to the axis of axial flow passage 106. The inner diameter of lateral bore 112 is at least greater than the outer diameter of gate 104. The axial length of lateral bore 112 is greater than the axial length of gate 104 such that gate 104 can reciprocate within lateral bore 112. Valve body 102 can have a bore opening 114 at one or both ends of lateral bore 112. A valve bonnet 116 can be used to cover bore opening 114. As one of skill in the art will appreciate, bonnet 116 can be attached to, and sealingly engage, valve body 102 by any of a variety of techniques including, for example, studs 118 as shown in FIG. 1. Bonnet 116 can have a seal (not shown in FIG. 1) to sealingly engage valve body 102. Shaft opening 119 can be an orifice located in an end of bonnet 116. Some embodiments can have fixed covers or the covers can be integrally formed of valve body 102 at the ends of axial flow passage 106, provided that the valve body can be separated or otherwise opened to allow the installation of gate 104.

Seat recess 120 is a counter bore within axial flow passage 106 that is proximate to lateral bore 112 for receiving and sealingly engaging seat 122. The inner diameter of seat recess 120 can be greater than the inner diameter of axial flow passage 106. One side of seat 122 is in a plane perpendicular to the axis of bore 106. The opposite side of seat 122 is saddle-shaped to sealingly engage the cylindrical side wall of gate 104 as gate 104 moves longitudinally and rotationally. Embodiments can have one seat recess 120, located above gate 104, or can have a pair of seat recesses 120 with one located above and one located below gate 104. Some embodiments can have no seats 122 and, thus, no seat recesses 120.

Gate 104 can be a cylinder rotated about a gate axis 124 as it is moved along gate axis 124. Gate 104 can be positioned within lateral bore 112, with gate axis 124 being parallel to the axis of lateral bore 112. Gate 104 can be moveable along gate axis 124, within lateral bore 112, from an open position to a closed position. Movement along gate axis 124 is defined as longitudinal movement. Gate 104 can permit flow through flow passage 106 in the open position, and a solid portion of the outer diameter gate 104 obstructs flow through flow passage 106 in the closed position. Seat 122 remains stationary while gate 104 is moved longitudinally and rotationally.

In some embodiments, gate 104 includes an orifice 126, which is an opening or passage through the outer diameter of gate body 128. Orifice 126 can be perpendicular to gate axis 124, such that orifice 126 is parallel to flow passage 106. When gate 104 is in the open position, orifice 126 can register with flow passage 106 to form a continuous path through valve assembly 100. When gate 104 is in the closed position, no part of orifice 126 is registered with flow passage 106, such that gate body 128 obstructs flow passage 106.

Figure 3:
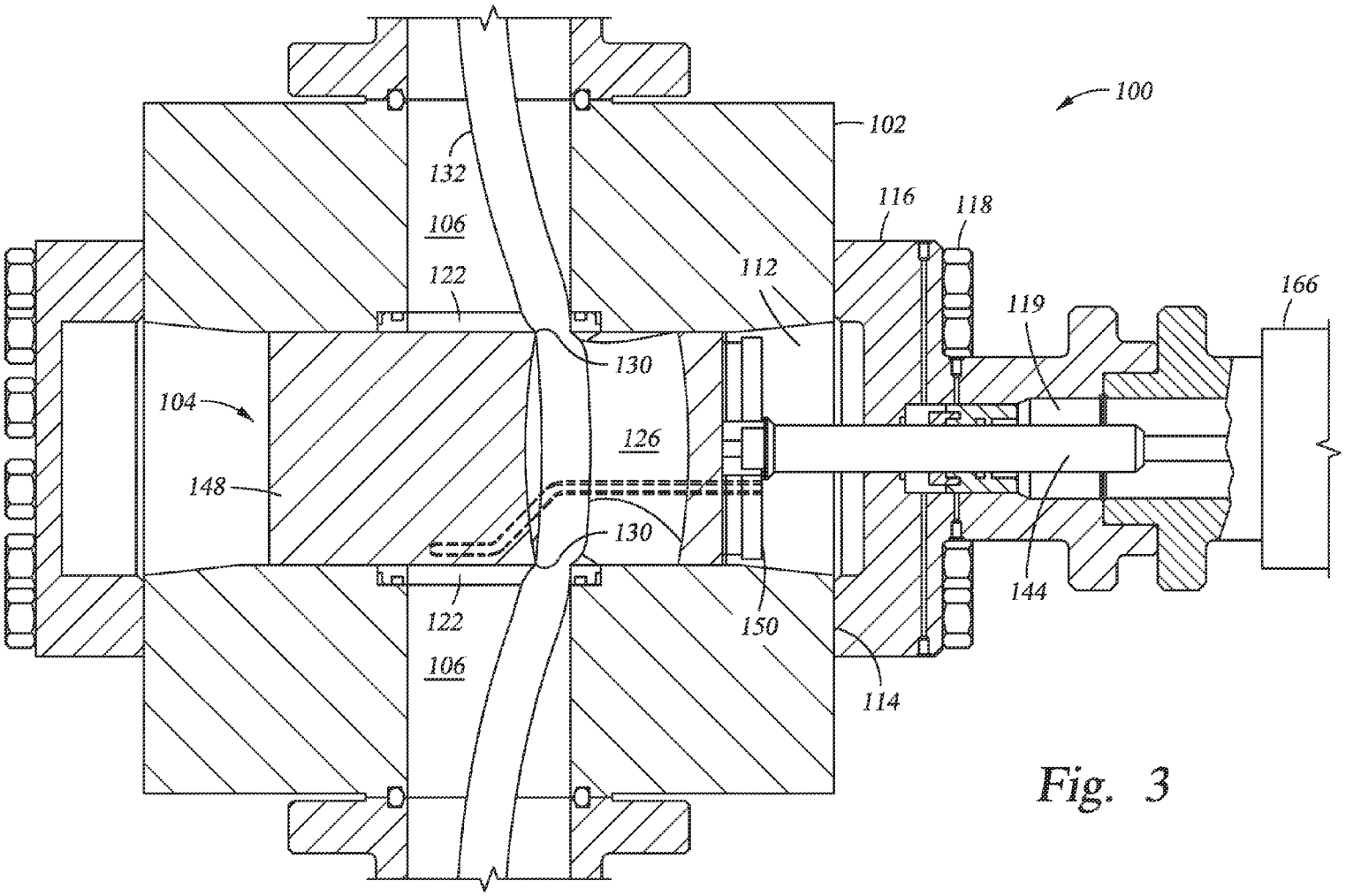
FIG. 3 is a sectional side view of the rotational shear valve of FIG. 1.

Orifice 126 can include a shear surface 130 (best shown in FIG. 3). Shear surface 130 is the last portion of orifice 126 to register with axial flow passage 106 as gate 104 moves from the open position to the closed position. As best shown in FIG. 3, any objects within flow passage 106, such as cable 132, are sheared between shear surface 130 and a surface of seat 122 or a surface of valve body 102. Any portion of the edge of orifice 126 can be a shear surface. For example, shear surface 130 can extend 360 degrees around the upper side and lower side of orifice 126. In some embodiments, shear surface 130 extends only part of the distance around the edge of orifice 126. In some embodiments, shear surface 130 can be located just on the upper side and not the lower side of orifice 130.

The outer diameter of gate body 128 can have a slot 134. Slot 134 can be a groove that extends helically, axially, or both along the outer diameter of gate body 128. As best shown in FIG. 1, slot 134 can included helical slot portion 136 rotating in a helical fashion about the outer diameter, extending around the outer diameter as it extends in the longitudinal direction. All or a portion of helical slot portion 136 can be radially aligned with at least a portion of orifice 126. In some embodiments, slot 134 can include straight slot portion 138, which can be a slot that extends axially along the outer diameter of gate body 128 and does not rotate helically. All or a portion of straight slot portion 138 can be located radially adjacent to at least a portion of orifice 126. Straight slot portion 138 can transition into helical slot portion 136 to form a single channel. Slot 134 can extend past the axial limits of orifice 126. In some embodiments, the transition point 140 from straight slot portion 138 to helical slot portion 136 can be radially alongside a portion of orifice 126, and can be a predetermined axial distance from shear surface 130.

Figure 2:
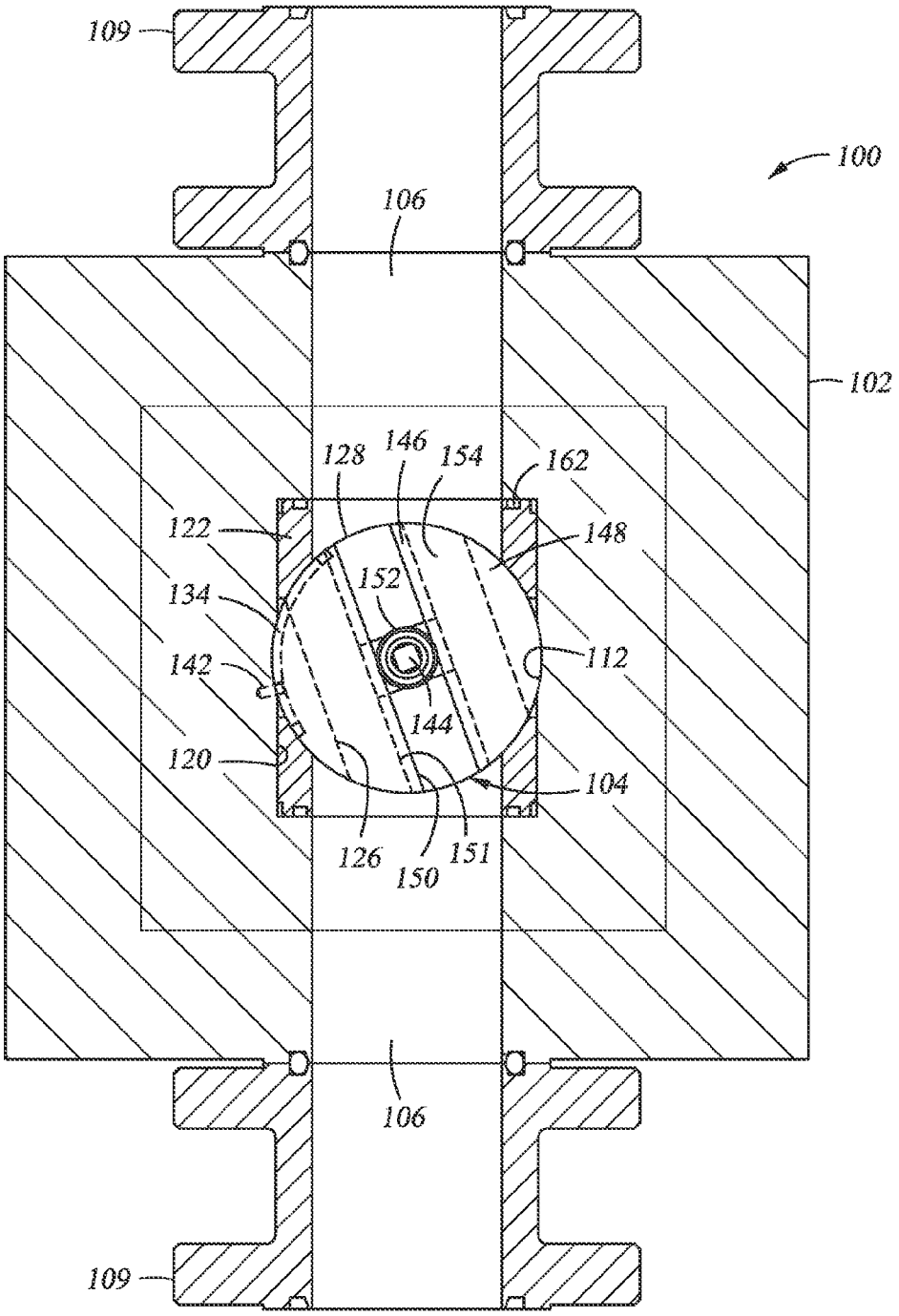
FIG. 2 is a sectional end view of the rotational shear valve of FIG. 1.

As best shown in FIG. 2, key 142 can protrude inwardly from the inner diameter of lateral bore 112 with at least a portion of key 142 engaging slot 134. Key 142 can be connected to valve body 102 by any of a variety of techniques. For example, key 142 can be a dowel that is pressed into a bore in the inner diameter surface of lateral bore 112. Alternatively, it can be a bolt or stud that threadingly engages a tapped hole in the inner diameter surface of lateral bore 112. In yet another embodiment, key 142 can be the tip of a bolt that is inserted through an opening from the exterior of valve body 102. Key 142 engages slot 134 and, when key 142 engages helical slot portion 136, can cause gate 104 to rotate as gate 104 moves longitudinally.

Referring back to FIG. 1, gate 104 can include a connector for connecting a valve stem 144 to gate 104. The connector can be, for example, a "t-slot" 146. T-slot 146 cart be a slot, or groove, spanning the diameter of end face 148 of gate 104. Lips 150 can extend inward from the edge 151 of t-slot 146 toward the center of t-slot 146. Stem 144 can have a flange 152 (best shown in FIG. 2) on at least one end, such that flange 152 can slidingly engage t-slot 146, and be retained by lips 150. In embodiments, gate 104 can rotate freely about its axis independent of stem 144. In some embodiments, flange 152 can freely rotate about its axis while it is in t-slot 146. Flange 152 can, for example, have a round shape so that it is not restrained by edges 151 of t-slot 146. In some embodiments, the opposite end of flange 144 can rotate independently from actuator 166 (FIG. 3). The outer diameter of the shaft of stem 144 can be less than or equal to the distance between the inward facing surfaces 154 of lips 150. The outer diameter of flange 152 can be greater than the distance between inward facing surfaces 154 of lips 150, but less than the distance between the edges 156 of t-slot 146.

As one of skill in the art will appreciate, an actuator 166 (FIG. 3) can be used to move gate 104 from the open position to the closed position. Actuator 166 can be any device to exert linear force against gate 104 in the direction of the gate axis 124, thus urging gate 104 toward either the open position or the closed position. In some embodiments, actuator 166 can be a hydraulic piston that is connected to valve stem 144, as shown in FIG. 3. In some embodiments, a remotely operated vehicle ("ROV") (not shown) can be the actuator that exerts axial force on valve stem 144.

Figure 4:
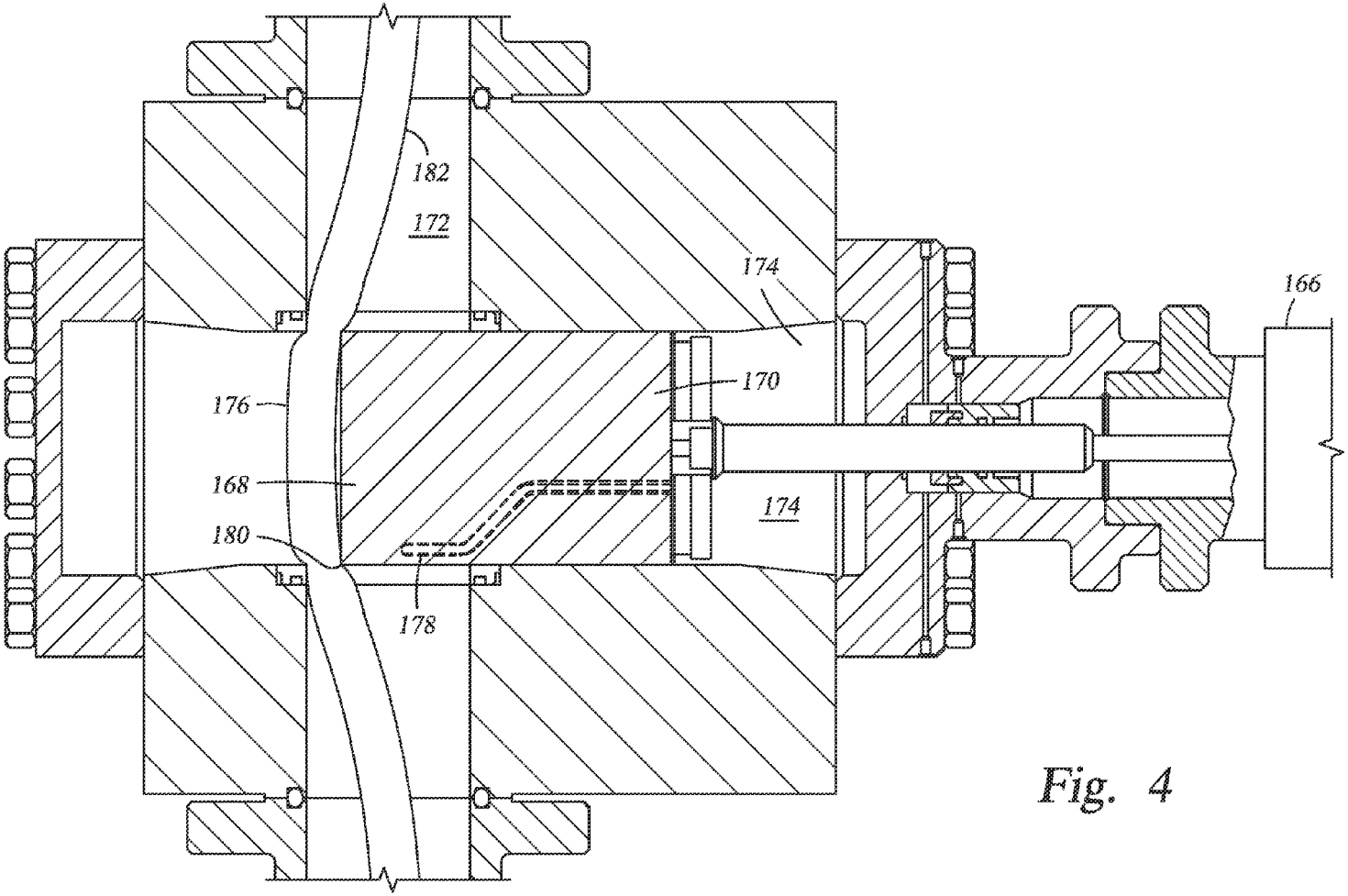
FIG. 4 is a sectional side view of a rotational shear valve according to an alternate embodiment of the invention.

FIG. 4 shows an embodiment that is different than the embodiment shown in FIGS. 1-3. In the embodiment shown in FIG. 4, gate 168 does not include an orifice. In this embodiment, gate body 170 obstructs flow passage 172 when gate 168 is in the closed position. In the open position, gate 168 is withdrawn through lateral bore 174 until end face 176 clears flow passage 172. Like the embodiments of FIGS. 1-3, gate 168 rotates about the gate axis while moving between the open and closed positions.

Slot 178 can be located on an outer diameter surface of gate 168. A helical slot portion of slot 178 can engage a key (not shown in FIG. 4) to cause gate 168 to rotate during all or a portion of the longitudinal movement of gate 168 through lateral bore 174. A shear surface 180 of end face 176, thus, can exert rotational and longitudinal shear forces against a cable 182 or production tubing (not shown) located within flow passage 172.

Referring back to FIGS. 1 and 2, seat 122 can be positioned in seat recess 120. Seat 122 can have an annular face 158, with grooves 160 for receiving a seal such as, for example, an o-ring 162 (FIG. 2). Saddle surface 164 of seat 122 can form a seal against the outer diameter of gate body 128. In embodiments, saddle surface 164 can have a contoured profile having an axial length that is longer away from the centerline of gate axis 124 and shorter along gate axis 124. An o-ring (not shown) or other seal element can be located in a groove (not shown) in saddle surface 164. As one of ordinary skill will appreciate, other seat configurations can be used to form a seal between the outer diameter of gate body 128 and valve body 102.

In operation, valve assembly 100 can be connected to and in communication with a tubular member, such as a riser or a wellhead housing. Cable 132 (FIG. 3) can pass through axial flow passage 106 as it suspends a wireline run tool (not shown) into the wellbore. Gate 104 can be in an open position, meaning that orifice 126 is registered with axial flow passage 106 such that orifice 126 is axially aligned and radially aligned with axial flow passage 106. Cable 132, thus, passes through orifice 126. In the event that the tubular member must be closed, gate 104 can be used to obstruct and seal axial passage 106, as well as shear cable 132. Actuator 166 (FIG. 3) can exert an axial force on valve stem 144 in the longitudinal direction to urge gate 104 from the open to the closed position. That force can be transferred through valve stem to gate 104. In the embodiment shown in FIG. 1, that force pulls gate 104 toward actuator 166.

As gate 104 moves in the longitudinal direction through lateral bore 112, key 142 rides in slot 134 to control the rotation of gate 104. As key 142 rides in the straight slot portion 138, gate 104 moves in the longitudinal direction without rotating about that axis 124. When key 142 engages helical slot portion 136, key 142 causes gate 104 to rotate about gate axis 124 as it continues to move in the longitudinal (along gate axis 124, and laterally relative to axial flow passage 106) in lateral bore 112. The movement along gate axis 124 causes orifice 126 to no longer be registered with axial flow passage 106, such that gate body 128 obstructs axial flow passage 106. The rotation caused by helical slot portion 136 engaging key 142 also causes orifice 126 to move out of axial alignment with axial flow passage 106. A member passing through axial flow passage 106, such as cable 132 or coil tubing (not shown), can be sheared by the longitudinal and the rotational movement of gate 104. Indeed, due to the longitudinal and rotational movement, the shear surface can be shifted away from the centerline of gate axis 124. In embodiments, cable 132 is trapped between shear edge 130 of gate 104 and a shear edge of seat 122, thereby causing the shearing. Cable 132 can be sheared before gate 104 is fully closed.

In some embodiments, the transition point 140 from straight slot portion 138 to helical slot portion 136 is a predetermined axial distance from shear surface 130 of the orifice 126 so that gate 104 begins to rotate when shear surface 130 is the preselected distance from a circumference of axial flow passage 106 or seat 122. In some embodiments, gate 104 begins to rotate just before cable 132 is pressed between shear surface 130 and an edge of saddle surface 164.

Figure 6:
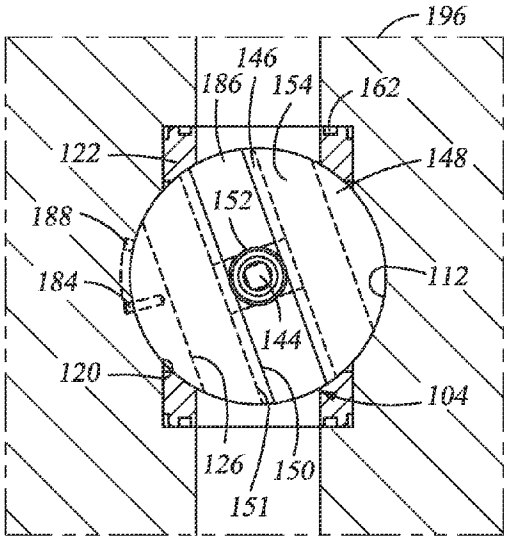
FIG. 6 is a sectional end view of the valve body of FIG. 5, showing the gate.
Figure 5:
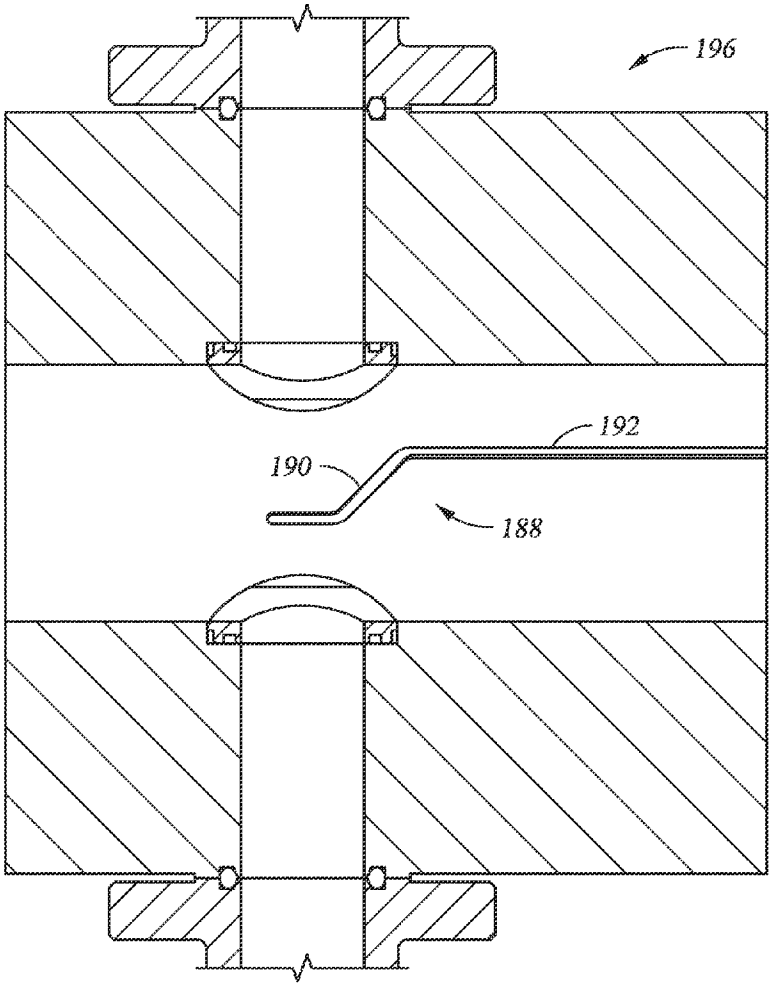
FIG. 5 is a sectional side view of the valve body, of a rotational shear valve, having a slot in the bore of the valve body, according to an embodiment of the invention.

Referring to FIGS. 5 and 6, some embodiments can use an alternate key and slot arrangement. For example, key 184 could protrude from the exterior surface of gate body 186. Slot 188 can be located on an interior surface of lateral bore 190. Helical slot 188 can have a helical portion 190 and a straight portion 192. As gate body 186 moves between the open and closed positions within valve body 196, key 184 can travel in slot 188 to cause gate body 194 to rotate.

Figure 8:
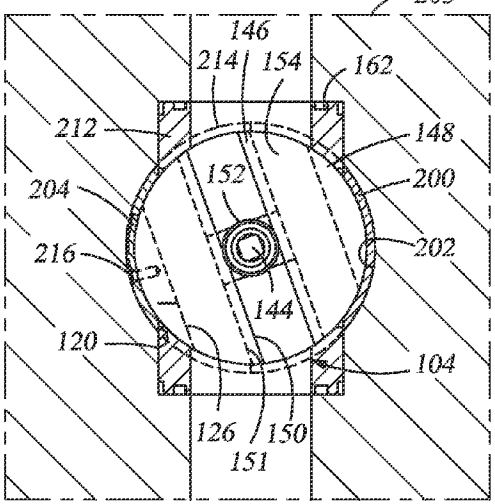
FIG. 8 is a sectional end view of the valve body of FIG. 7, showing the gate and the sleeve.
Figure 7:
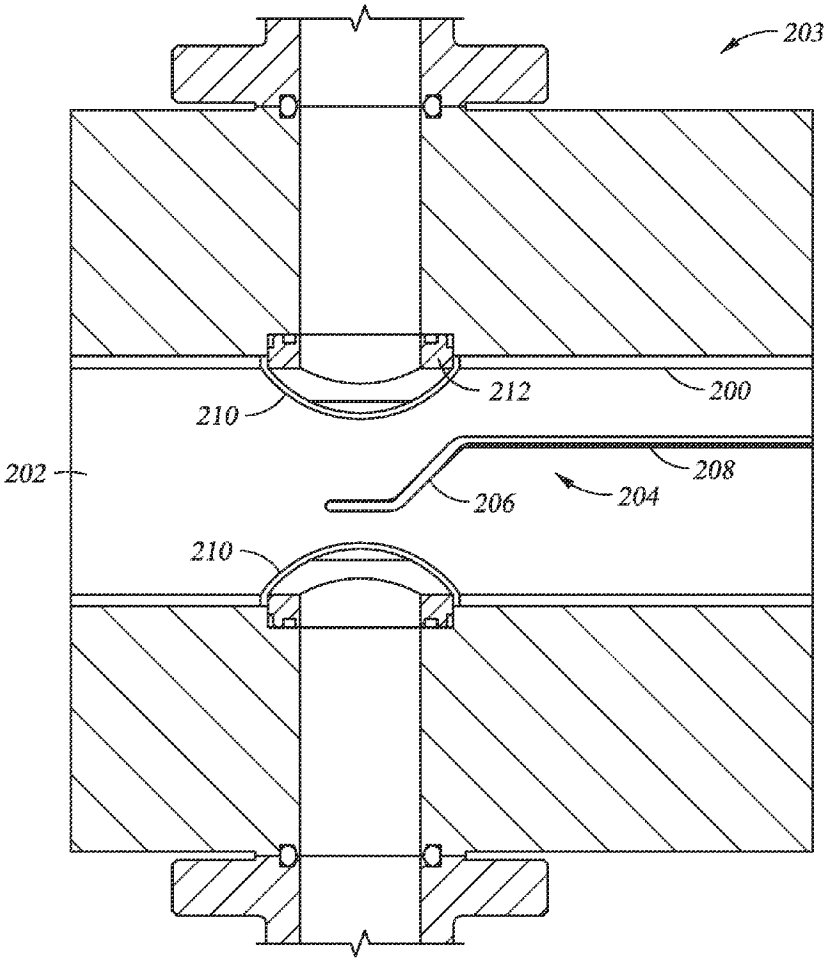
FIG. 7 is a sectional side view of the valve body, of a rotational shear valve, having a sleeve in the bore of the valve body and the slot in an inner diameter surface of the sleeve, according to an embodiment of the invention

Referring to FIGS. 7 and 8, in some embodiments, a cylinder, or sleeve 200, can be positioned within lateral bore 202 of valve body 203. Sleeve 200 can, thus, define the inner diameter of lateral bore 202. Sleeve 200 can be a thin-walled sleeve. In embodiments, it can be a few millimeters thick. In some embodiments, it can range from, for example, about 2-10 millimeters thick. In some embodiments, it can range from, for example, about 2-5 millimeters thick. Slot 204 can be located on an interior surface of sleeve 200. Slot 204, which can include helical portion 206 and straight portion 208, can be any depth, up to the thickness of sleeve 200. In embodiments, slot 204 can have a depth, for example, equal to about half of the thickness of sleeve 200. In embodiments, slot 204 can be all the way through sleeve 200. In some embodiments, sleeve 200 can have cutouts 210 to allow sleeve 200 to accommodate seats 212. Cutouts can have a generally round shape wherein the circumference is surrounded or mostly surrounded by the material of sleeve 200. Seats 212 can be inserted through cutouts 210 after sleeve 200 is inserted into bore 202. In some embodiments, the cutouts can be u-shaped such that they are open on one end so that the sleeve can be inserted with the seats already in place. In embodiments, sleeve 200 is secured in place so that it cannot rotate relative to bore 202. In some embodiments, the edges of cutouts 210 can engage the edges of seats 212 to prevent sleeve 200 from rotating within bore 202.

In embodiments having a sleeve 200, gate body 214 can have a smaller diameter than embodiments that do not have a sleeve 200 to accommodate the thickness of sleeve 200. By reducing the outer diameter of gate body 214 in embodiments having a sleeve 200, the dimensions of valve body 203, and bore 202, need not be changed. Seats 212 may need to be longer, however, so that they can engage the reduced-diameter of gate body 214. Thus, a sleeve 200 can be inserted into a standard valve body. Key 216 can be a dowel or stud protruding from gate 216. Key 216 can ride in slot 204, such that helical portion 206 causes gate 216 to rotate and straight portion 208 permits gate 216 to move laterally without rotating. In embodiments having a sleeve, the sleeve can be split into two or more segments to facilitate easier manufacture and assembly.

While the invention has been shown or described in only some of its forms, it should be apparent to those skilled in the art that it is not so limited, but is susceptible to various changes without departing from the scope of the invention.

What is claimed is:

1. A valve assembly comprising:

a valve body having an axial flow passage therethrough and a lateral bore transverse to the axial flow passage; and a gate, the gate comprising a cylinder rotated about a gate axis, the gate being located within the lateral bore and moveable in a longitudinal direction along the gate axis from an open position to a closed position, the gate moveable in the longitudinal direction along the gate axis by a linear force applied against the gate in the direction of the gate axis, the gate permitting flow through the axial flow passage in the open position and a solid portion of the outer diameter of the gate obstructing the axial flow passage in the closed position, and the gate rotating about the gate axis while moving axially from the open position to the closed position, wherein the valve body is shaped to engage the gate as it moves in the longitudinal direction along the gate axis and initiate rotation of the gate about the gate axis between the open and closed positions when a shear surface of the gate is a predetermined axial distance from the closed position, and wherein the shear surface of the gate is operable to exert simultaneous axial and rotational shear forces against a conduit disposed in the axial flow passage while moving between the open position and the closed position, such that a fully severed section of the conduit is swept into an orifice of the gate, thereby reducing damage to the shear surface of the gate by preventing severed material of the severed section from being caught between the shear surface of the gate and the valve body, the orifice being perpendicular to the gate axis and having opposite ends at the outer diameter of the gate, the orifice registering with the axial flow passage in the open position.

2. A valve assembly according to claim 1, wherein the gate comprises a slot on the outer diameter of the gate, the slot having a helical portion extending around the outer diameter as it extends in the direction of the gate axis, and wherein the valve body comprises a key, at least a portion of the key being located in the slot, so that when the gate moves along the gate axis, the key causes the gate to rotate about the gate axis.

3. A valve assembly according to claim 2, wherein the slot further comprises a straight portion that extends along the gate axis and does not rotate helical fashion about the outer diameter and the key is located in the straight portion of the slot when the valve is in the open position so that when the gate moves from the open position to the closed position, the gate initially moves along the gate axis without rotating and then begins rotating when the key reaches the helical portion.

4. A valve assembly according to claim 1, further comprising:

a valve stem connected to an end of the gate; and an actuator connected to the valve stem, the actuator creating force in the direction of the gate axis to urge the gate, via the valve stem, between the open and closed positions.

5. A valve assembly according to claim 1, wherein the valve body further comprises a slot on an inner diameter of the lateral bore, the slot having a helical portion extending around the outer diameter as it extends in the direction of the gate axis, and the gate further comprises a key protruding from the gate, at least a portion of the key being located in the slot, so that when the gate moves along the gate axis, the key causes the gate to rotate about the gate axis.

6. A valve assembly according to claim 5, wherein the valve body further comprises a cylindrical sleeve lining the lateral bore, the cylindrical sleeve defining the inner diameter of the lateral bore and the slot being located on an inner diameter of the cylindrical sleeve.

7. A valve assembly according to claim 1, wherein the gate comprises an end face, the end face having a shear surface, and wherein the shear surface rotates about the gate axis while the gate is moving from the open to closed position.

8. A method for sealing a passage, the method comprising:

providing a valve body having a flow passage therethrough;

providing a gate, the gate comprising a cylinder rotated about a gate axis, the gate being located within the valve body and moveable in a longitudinal direction along the gate axis from an open position to a closed position, the gate permitting flow through the flow passage in the open position and a solid portion of the outer diameter of the gate obstructing the flow passage in the closed position, wherein the valve body is shaped to engage the gate as it moves in the longitudinal direction along the gate axis and initiate rotation of the gate about the gate axis between the open and closed positions when a shear surface of the gate is a predetermined axial distance from the closed position;

exerting force on the gate in the direction of the gate axis to cause the gate to move in the direction of the gate axis from the open to the closed position, the gate rotating about the gate axis as it moves from the open position to the closed position; and shearing a cable located in the flow passage with axial and rotational shear forces from the gate as the gate moves from the open position to the closed position, wherein the shear surface of the gate is operable to exert simultaneous axial and rotational shear forces against the cable disposed in the flow passage while moving between the open position and the closed position, such that a fully severed section of the cable is swept into an orifice of the gate, thereby reducing damage to the shear surface of the gate by preventing severed material of the severed section from being caught between the shear surface of the gate and the valve body.

9. A method according to claim 8, further comprising the step of moving the gate in the direction of the gate axis for a predetermined distance without rotating the gate and then continuing to move the gate in the direction of the gate axis while causing the gate to rotate about the gate axis.

10. A valve assembly comprising:

a valve body having an axial flow passage therethrough; and a gate, the gate comprising a cylinder rotated about a gate axis and an orifice perpendicular to the gate axis, the gate being located within the valve body and moveable in a longitudinal direction along the gate axis from an open position to a closed position, the orifice registering with the axial flow passage in the open position and the gate rotating about the gate axis while moving axially from the open position to the closed position, wherein the valve body is shaped to engage the gate as it moves in the longitudinal direction along the gate axis and initiate rotation of the gate about the gate axis between the open and closed positions when a shear surface of the gate is a predetermined axial distance from the closed position;

at least one seat located in the valve body, the at least one seat forming a seal against an outer diameter of the gate; and a shear surface at an end of the orifice, the shear surface being the last portion of the orifice to register with the axial flow passage as the gate moves from the open position to the closed position, wherein the shear surface is operable to exert simultaneous axial and rotational shear forces against a conduit disposed in the axial flow passage while moving between the open position and the closed position, such that a fully severed section of the conduit is swept into the orifice of the gate, thereby reducing damage to the shear surface of the gate by preventing severed material of the severed section from being caught between the shear surface of the gate and the seat.

11. A valve assembly according to claim 10, wherein the gate comprises a slot on an outer diameter, at least a portion of the slot being a helical slot rotating in a helical fashion about the outer diameter, extending around the outer diameter as it extends in the direction of the gate axis, and wherein the valve body comprises a key, at least a portion of the key being located in the slot, so that when the gate moves along the gate axis, the key causes the gate to rotate about the gate axis.

12. A valve assembly according to claim 11, wherein at least a portion of the slot is a straight slot that extends along the gate axis and does not rotate in helical fashion about the outer diameter and the key is located in the straight slot when the valve is in the open position so that when the gate moves from the open position to the closed position, it initially moves along the gate axis without rotating and then begins rotating when the key reaches the helical slot.

13. A valve assembly according to claim 10, further comprising:

a valve stem connected to an end of the gate; and an actuator connected to the valve stem, the actuator creating force in the direction of the gate axis to urge the gate, via the valve stem, between the open and closed positions.

14. A valve assembly according to claim 10, wherein the longitudinal and rotational shear forces have sufficient strength to shear at least one of a cable and a wellbore production tubing.

15. A valve assembly according to claim 10, wherein the valve body further comprises a slot on an inner diameter of a lateral bore, the slot having a helical portion extending around the outer diameter as it extends in the direction of the gate axis, and the gate further comprises a key protruding from the gate, at least a portion of the key being located in the slot, so that when the gate moves along the gate axis, the key causes the gate to rotate about the gate axis.

16. A valve assembly according to claim 10, wherein the valve body further comprises a cylindrical sleeve lining a lateral bore, the cylindrical sleeve defining the inner diameter of the lateral bore and the slot being located on an inner diameter of the cylindrical sleeve.

17. A valve assembly comprising:

a valve body having an axial flow passage therethrough and a lateral bore transverse to the axial flow passage; and a gate, the gate comprising a cylinder rotated about a gate axis, the gate being located within the lateral bore and moveable in a longitudinal direction along the gate axis from an open position to a closed position, the gate permitting flow through the axial flow passage in the open position and a solid portion of the outer diameter of the gate obstructing the axial flow passage in the closed position, the gate comprises a slot on the outer diameter of the gate, the gate comprises an orifice, and the gate rotating about the gate axis while moving axially from the open position to the closed position, the slot having a helical portion extending around the outer diameter as it extends in the direction of the gate axis, and wherein the valve body comprises a key, at least a portion of the key being located in the slot, so that when the gate moves along the gate axis, the key causes the gate to rotate about the gate axis, the slot further comprises a straight portion that extends along the gate axis and does not rotate in helical fashion about the outer diameter and the key is located in the straight portion of the slot when the valve is in the open position so that when the gate moves from the open position to the closed position, the gate initially moves along the gate axis without rotating and then begins rotating when the key reaches the helical portion, the orifice being perpendicular to the gate axis and having opposite ends at the outer diameter of the gate, the orifice registering with the axial flow passage in the open position and having a shear surface, the shear surface being the last portion of the orifice to register with the axial flow passage as the gate moves from the open position to the closed position, and wherein the transition from the straight portion of the slot to the curved portion of the slot is a predetermined axial distance from the shear surface of the orifice so that the gate begins to rotate when the shear surface is the predetermined axial distance crossing a circumference of the axial flow passage, wherein the shear surface of the gate is operable to exert simultaneous axial and rotational shear forces against a conduit disposed in the axial flow passage while moving between the open position and the closed position, such that a fully severed section of the conduit is swept into the orifice of the gate, thereby reducing damage to the shear surface of the gate by preventing severed material of the severed section from being caught between the shear surface of the gate and the valve body.

* * * * *